US007874876B1

(12) United States Patent
Huang

(10) Patent No.: US 7,874,876 B1
(45) Date of Patent: Jan. 25, 2011

(54) AUDIO JACK CONNECTOR

(75) Inventor: Sheng-Yuan Huang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/635,504

(22) Filed: Dec. 10, 2009

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS 6,568,963 B2 * 5/2003 Zhang et al. ..... 439/668
7,604,513 B2 * 10/2009 Wang et al. ..... 439/668
7,794,285 B1 * 9/2010 Huang ..... 439/668

* cited by examiner

*Primary Examiner*—Gary F. Paumen
(74) *Attorney, Agent, or Firm*—Cheng-Ju Chiang

(57) ABSTRACT

An audio jack connector includes an insulating housing and a plurality of terminals disposed in the insulating housing. The insulating housing defines a plug insertion hole from a front end to a rear end thereof for receiving an audio plug connector and a recess communicating with a rear end of the plug insertion hole. The terminals includes a contact terminal received in the recess and having a base portion received in a bottom of the recess. One end of the base portion is bent upward and extended towards the other end of the base portion to form a first elastic arm. A side edge of the base portion is extended upward and then bent to form a second elastic arm of substantially L shape. A first contact portion and a second contact portion are protruded into the plug insertion hole from free ends of the first elastic arm and the second elastic arm, respectively.

6 Claims, 4 Drawing Sheets

AUDIO JACK CONNECTOR

BACKGROUND OF THE INVENTION

1. Field of the Invention

The present invention generally relates to a connector, and more particularly to an audio jack connector.

2. The Related Art

Referring to FIG. 6, a conventional audio jack connector 4 for mating with an audio plug connector 5 includes an insulating housing 41 and a plurality of terminals disposed in the insulating housing 41. The terminals include a plurality of spring terminals 421 and a contact terminal 422 disposed in the insulating housing 41 for contacting the audio plug connector 5, respectively. The insulating housing 41 defines a plug insertion hole 411 from a front end to a rear end thereof to receive the audio plug connector 5. The contact terminal 422 has a base portion 4221 disposed in a rear end of the plug insertion hole 411 of the insulating housing 41, a soldering portion 4222 exposed out of the plug insertion hole 411 to be soldered with a printed circuit board (not shown) and a contact portion 4223 stretching into the plug insertion hole 411 for contacting with the audio plug connector 5 at a side of the audio plug connector 5. However, when the audio plug connector 5 is inserted with force in a direction oblique to the axis of the plug insertion hole 411, the audio plug connector 5 is apt to tilt to a side of the plug insertion hole 411 so that make the electrical connection between the audio jack connector 4 and the corresponding audio plug connector 5 become unstable.

SUMMARY OF THE INVENTION

An object of the invention is to provide an audio jack connector for receiving an audio plug connector with a tip end. The audio jack connector includes an insulating housing and a plurality of terminals disposed in the insulating housing. The insulating housing defines a plug insertion hole from a front end to a rear end thereof for receiving the audio plug connector and a recess communicating with a rear end of the plug insertion hole. The terminals include a contact terminal received in the recess and having a base portion received in a bottom of the recess. One end of the base portion is bent upward and extended towards the other end of the base portion to form a first elastic arm located over the base portion and under the tip end of the audio plug connector when the audio plug connector is inserted in the plug insertion hole. A side edge of the base portion is extended upward and then bent along the axis of the plug insertion hole to form a second elastic arm of substantially L shape located at a side of the tip end of the audio plug connector when the audio plug connector is inserted in the plug insertion hole. A first contact portion and a second contact portion are protruded into the plug insertion hole from free ends of the first elastic arm and the second elastic arm respectively for abutting against a lower portion and a side portion of the tip end of the audio plug connector.

As described above, the audio jack connector utilizes the contact terminal for making the audio plug connector disposed in the plug insertion hole of the insulating housing of the audio jack connector firmly by means of the first contact portion and the second contact portion abutting against the lower portion and the side portion of the tip end of the audio plug connector respectively so as to form a steady electrical connection between the audio jack connector and the corresponding audio plug connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
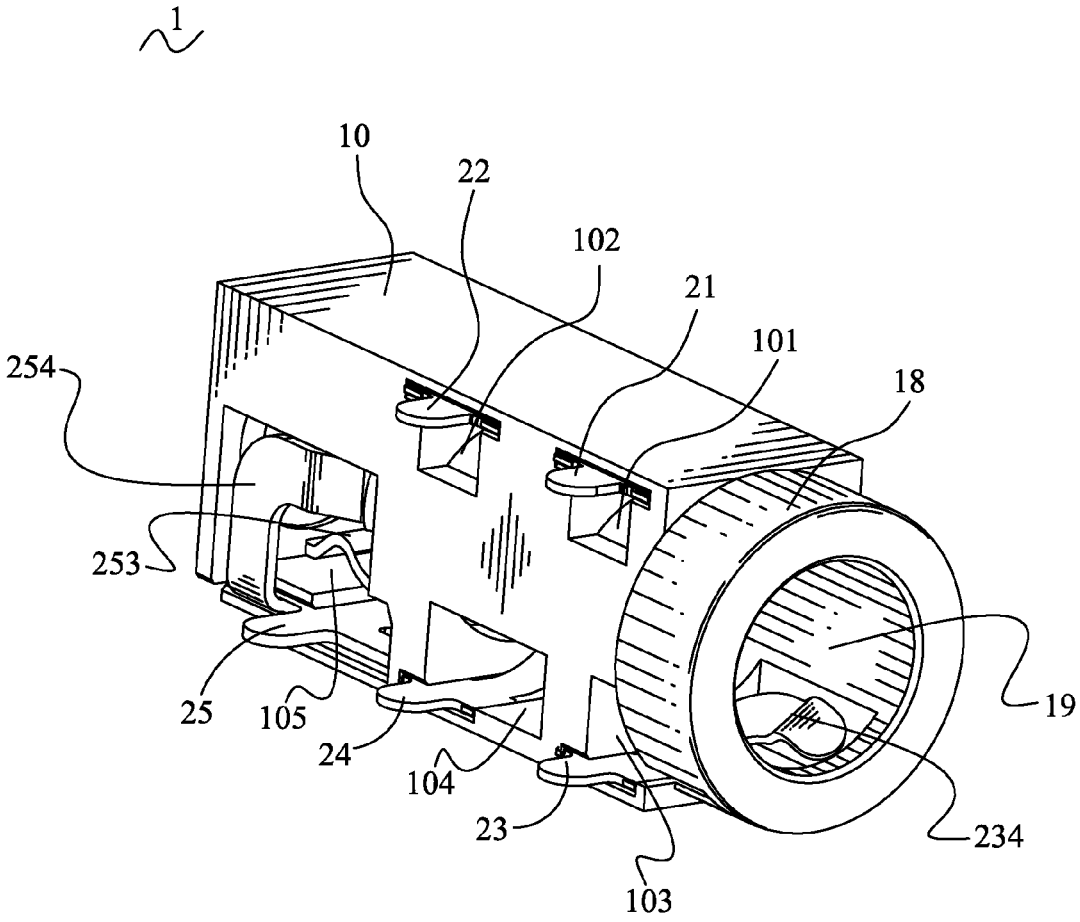
FIG. 1 is a perspective view of an audio jack connector in accordance with the present invention.
Figure 2:
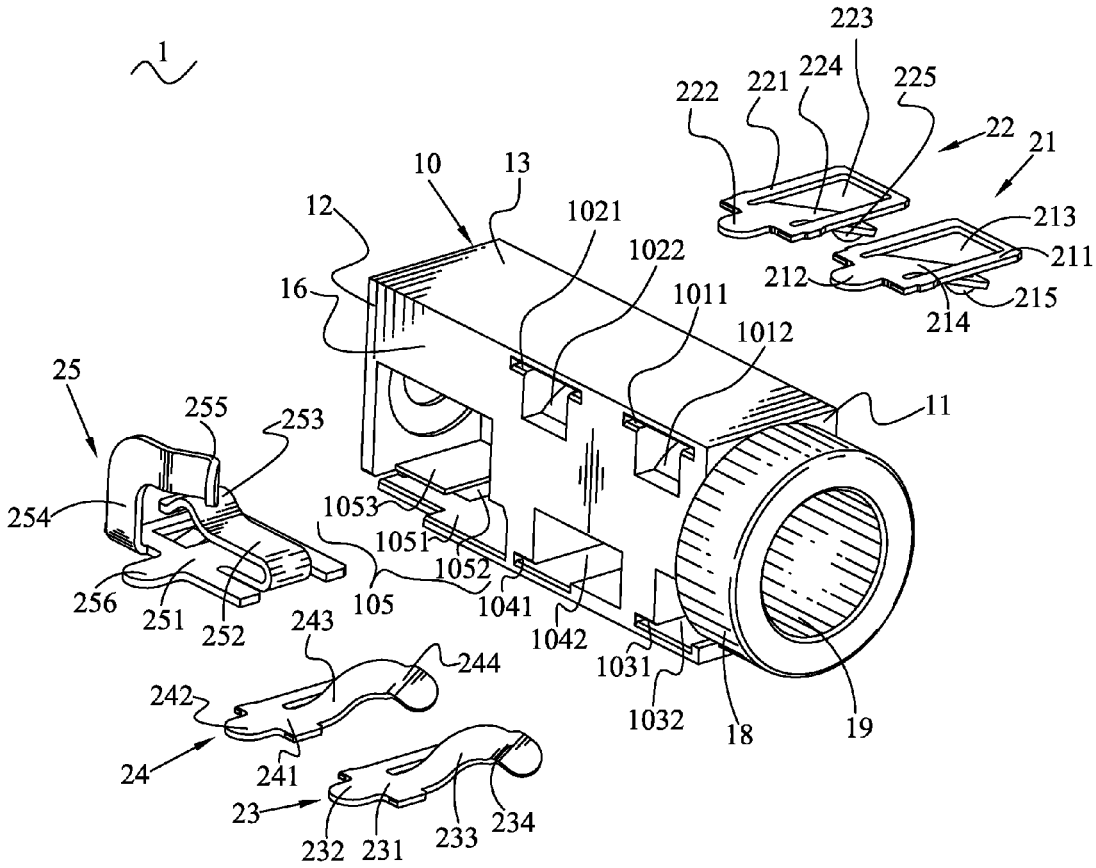
FIG. 2 is an exploded view of the audio jack connector of FIG. 1.
Figure 3:
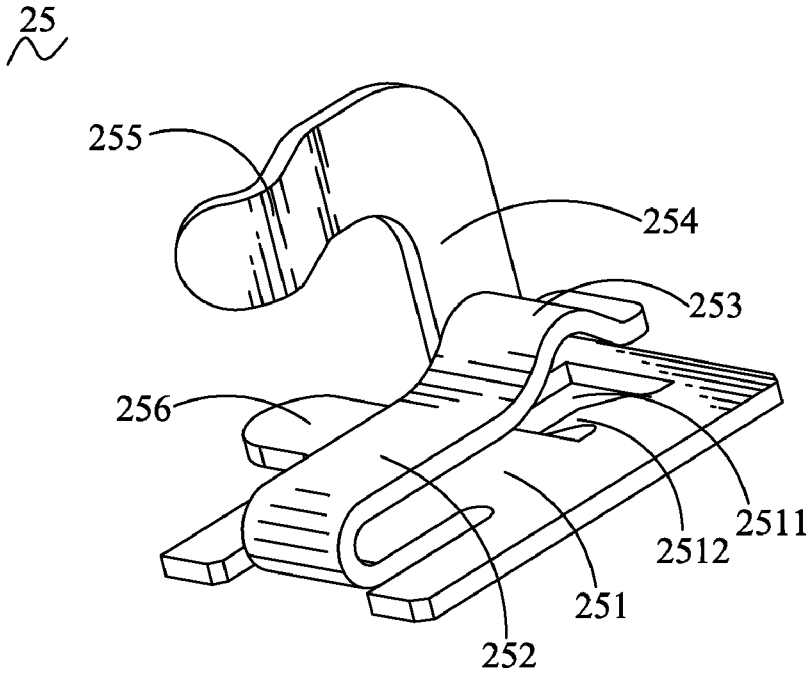
FIG. 3 is a perspective view of a contact terminal of the audio jack connector of FIG. 1.
Figure 4:
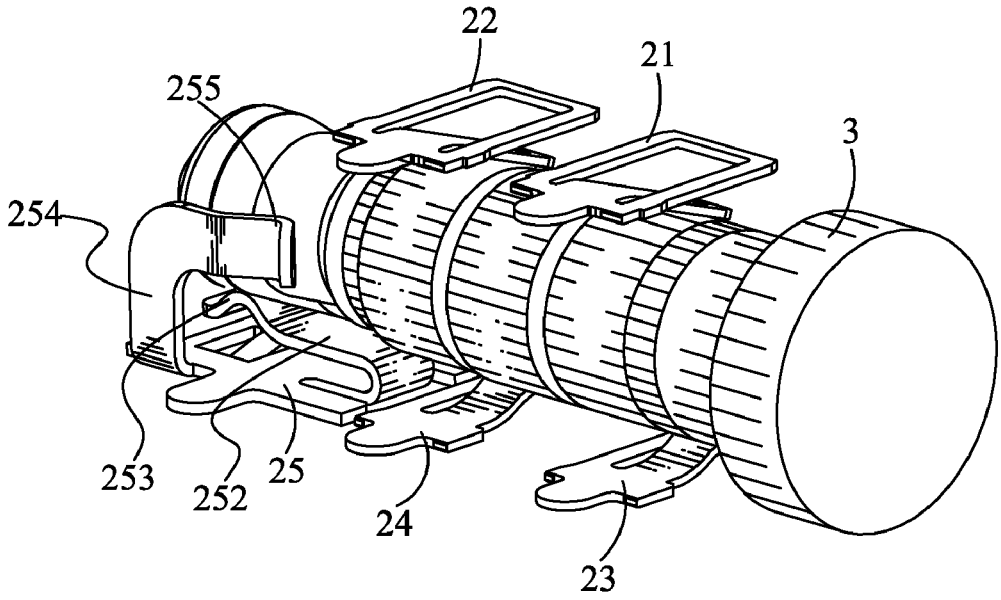
FIG. 4 is a perspective view of a plurality of terminals of the audio jack connector of FIG. 1, showing the terminals contacting with an audio plug connector.
Figure 5:
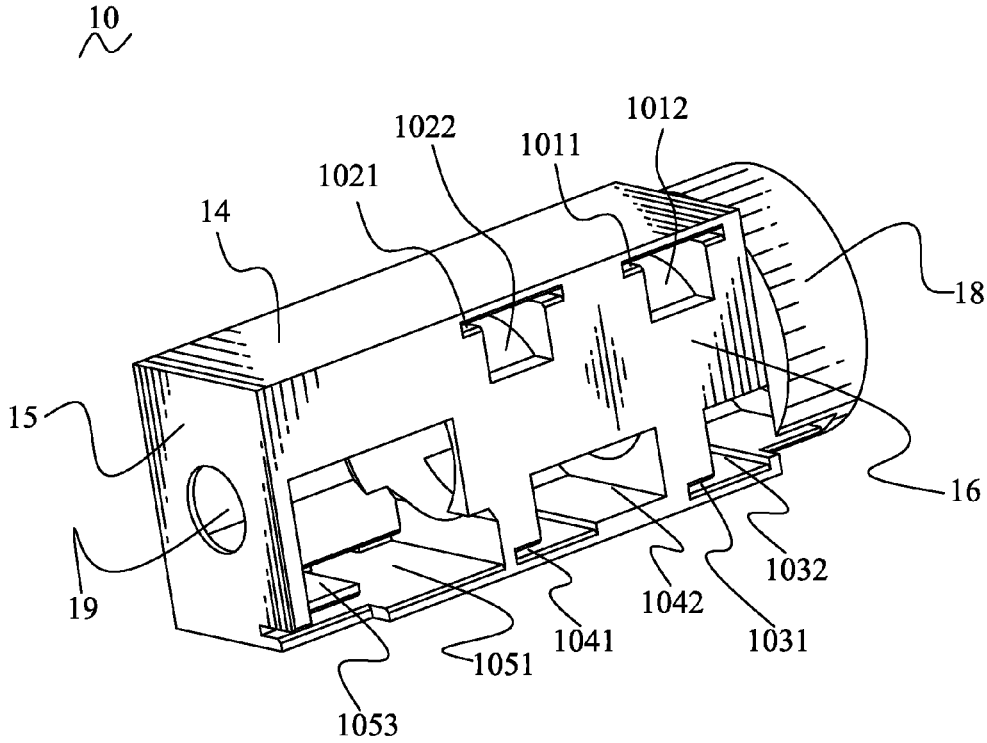
FIG. 5 is a perspective view of an insulating housing of the audio jack connector of FIG. 1.
Figure 6:
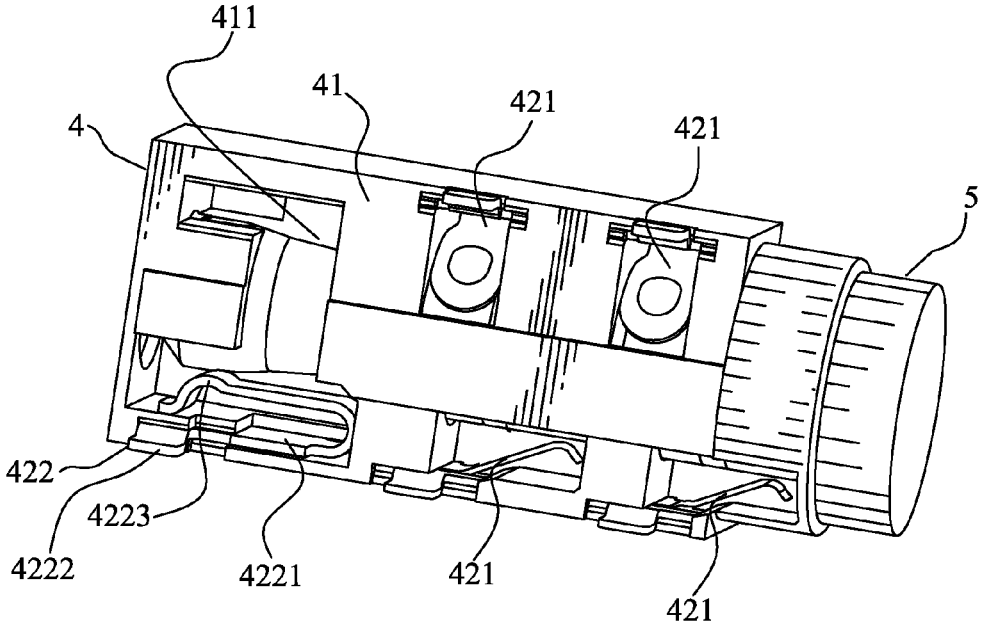
FIG. 6 (Prior Art)
FIG. 6 is a perspective view of an audio jack connector according to a prior art, in which an audio plug connector is inserted.

Referring to FIGS. 1-2 and FIG. 4, an audio jack connector 1 according to the present invention is shown. The audio jack connector 1 includes an insulating housing 10 and a plurality of terminals disposed in the insulating housing 10. Herein, supposing an audio plug connector 3 with a tip end is inserted into the audio jack connector 1 along a front and rear inserting direction, for clear description.

Referring to FIGS. 1-5, the insulating housing 10 is of a substantially rectangular shape and defines a front end 11, a rear end 12 opposite to the front end 11, a top surface 13, a bottom surface 14 opposite to the top surface 13, a rear surface 15, a first lateral surface 16 and a second lateral surface (not shown) opposite to the first lateral surface 16. The front end 11 has a substantial middle portion protruded outwards to form a circular platform 18. A plug insertion hole 19, with a circular cross-section, is formed in the insulating housing 10 and passes through middle portions of the platform 18 and the rear end 12 of the insulating housing 10 for receiving the mating audio plug connector 3 from a front portion thereof. The insulating housing 10 defines a first groove 101, a second groove 102, a third groove 103, a fourth groove 104 and a recess 105.

The first groove 101 has a first fixing groove 1011 located at a front portion of the first lateral surface 16 adjacent to the top surface 13 and extending transversely and longitudinally to pass through the second lateral surface. The first lateral surface 16 further defines a rectangular first receiving cavity 1012 extending transversely to connect with a middle of the first fixing groove 1011, lower than the first fixing groove 1011 and communicating with the plug insertion hole 19. The second groove 102 is of the same structure as the first groove 101 and located in rear of the first groove 101. The second groove 102 and the first groove 101 are aligned with each other along a longitudinally direction. The second groove 102 has a second fixing groove 1021 and a second receiving cavity 1022. The third groove 103 has a rectangular third fixing groove 1031 located at a front portion of the first lateral surface 16 adjacent to the bottom surface 14 and extending longitudinally. The first lateral surface 16 further defines a rectangular third receiving cavity 1032 extending transversely to communicate with the third fixing groove 1031 and the plug insertion hole 19. The third receiving cavity 1032 connects with a top end of the third fixing groove 1031 and biased from the third fixing groove 1031. The fourth groove 104 is of the same structure as the third groove 103 and located in rear of the third groove 103. The third groove 103 and the fourth groove 104 are aligned with each other along a longitudinally direction. The fourth groove 104 has a fourth fixing groove 1041 and a fourth receiving cavity 1042.

The recess 105 communicates with a rear end of the plug insertion hole 19. A portion of a bottom wall 1051 of the recess 105 defines a rectangular locating groove 1052 and adjacent to the rear surface 15 of the insulating housing 10. A portion of a rear wall of the recess 105 is protruded in the recess 105 along the axis of the plug insertion hole 19 to form a preventing board 1053 suspended over the bottom wall 1051.

Referring to FIGS. 1-5, the terminals received in the insulating housing 10 divided into a first terminal group, a second terminal group and a contact terminal 25. The first terminal group includes a first terminal 21 and a second terminal 22, which are received in the first groove 101 and the second groove 102, respectively. The first terminal 21 has a rectangular first fixing board 211 disposed levelly and fixed in the first fixing groove 1011 of the first groove 101. An edge of the first fixing board 211 extends sideward to form a first soldering portion 212. A middle of the first fixing board 211 defines a first opening 213 perpendicularly passing therethrough. An inner edge of the first opening 213 which is adjacent to the first soldering portion 212 extends obliquely to form a first elastic portion 214 under the first fixing board 211. A tip end of the first elastic portion 214 protrudes downward to form a first contact lump 215. The first soldering portion 212 is exposed outside the first lateral surface 16 to be soldered with a printed circuit board (not shown). The first elastic portion 214 is received in the first receiving cavity 1012 and stretches into the plug insertion hole 19 for making the first contact lump 215 on the first elastic portion 214 contacting with the mating audio plug connector 3. The second terminal 22 is of the same structure as the first terminal 21. The second terminal 22 has a second fixing board 221 fixed in the second fixing groove 1021 of the second groove 102, a second soldering portion 222 exposed outside the first lateral surface 16 to be soldered with the printed circuit board, a second opening 223 and a second elastic portion 224 received in the second receiving cavity 1022 and stretching into the plug insertion hole 19 so as to make a second contact lump 225 on the second elastic portion 224 contact with the mating audio plug connector 3.

The second terminal group includes a third terminal 23 and a fourth terminal 24, which are received in the third groove 103 and the fourth groove 104, respectively. The third terminal 23 has a third fixing board 231 extending longitudinally and disposed levelly. A side edge of the third fixing board 231 extends sideward to form a third soldering portion 232. An opposite side edge of the third fixing board 231 extends obliquely to form a third elastic portion 233 higher than the third fixing board 231. A first contact rib 234 is formed by a free end of the third elastic portion 233 being arched into the plug insertion hole 19. The third fixing board 231 is fixed in the third fixing groove 1031 of the third groove 103. The third soldering portion 232 is exposed outside the first lateral surface 16 to be soldered with the printed circuit board. The third elastic portion 233 is received in the third receiving cavity 1032 and stretches into the plug insertion hole 19 for making the first contact rib 234 on the third elastic portion 233 contacting with the mating audio plug connector 3. The fourth terminal 24 is of the same structure as the third terminal 23. The fourth terminal 24 has a fourth fixing board 241 fixed in the fourth fixing groove 1041 of the fourth groove 104, a fourth soldering portion 242 exposed outside the first lateral surface 16 to be soldered with the printed circuit board and a fourth elastic portion 243 received in the fourth receiving cavity 1042 and stretching into the plug insertion hole 19 so as to make the fourth contact rib 244 on the fourth elastic portion 243 contact with the mating audio plug connector 3.

The contact terminal 25 is received in the recess 105. The contact terminal 25 has a plate-shaped base portion 251. The base portion 251 is received at a bottom of a rear of the recess 105. A middle of one end of the base portion 251 is bent upward and then extended towards the other end thereof to form a first elastic arm 252 paralleling to and suspended over the base portion 251. A first contact portion 253 is formed by a free end of the first elastic arm 252 being arched into the plug insertion hole 19. The base portion 251 further defines a substantially rectangular gap 2511 vertically passing therethrough under the first contact portion 253. An inner edge of the gap 2511 is protruded downward obliquely to form a tab 2512. Two sides of the one end of the base portion 251 where the first elastic arm 252 is extended is cut so as to make the first elastic arm 252 gain elasticity. A portion of a side edge of the base portion 251 adjacent to the gap 2511 is extended upward and then bent along the axis of the plug insertion hole to form a substantially lying L-shaped second elastic arm 254. The base portion 251 and the second elastic arm 254 cooperate to show a substantial lying-U shape. A second contact portion 255 is formed by a free end of the second elastic arm 254 being arched into the plug insertion hole 19. A portion of the side edge of the base portion 251 is extended outward to form a fifth soldering portion 256 spaced from the second elastic arm 254 and adjacent to the first elastic arm 252. The base portion 251 is located between the preventing board 1053 and the bottom wall 1051 of the recess 105 with the tab 2512 being buckled into the locating groove 1052 for ensuring a firm engagement between the contact terminal 25 and the insulating housing 10. The first elastic arm 252 is located above the preventing board 1053 and the second elastic arm 254 is located at a side of the recess 105 adjacent to the first lateral surface 16. The contact portions 253, 255 stretch into the plug insertion hole 19 for contacting with the tip end of the mating audio plug connector 3. The fifth soldering portion 256 is exposed outside the first lateral surface 16 for being soldered with the printed circuit board.

Referring to FIGS. 1-5, in use, when the corresponding audio plug connector 3 is completely inserted into the plug insertion hole 19 of the insulating housing 10 of the audio jack connector 1. The contact lumps 215, 225, the contact ribs 234, 244 and the contact portions 243, 255 will electrically contact with the corresponding audio plug connector 3, which makes audio signals transmit between the audio jack connector 1 and the mating audio plug connector 3. The preventing board 1053 located between the base portion 251 and the first contact portion 253 is used for preventing the first elastic arm 252 from being overly pressed by the mating plug connector 3 to reduce the deformation when the tip end of the mating audio plug connector 3 abuts against the first contact portion 253 on the first elastic arm 252. The second contact portion 255 is in front of the first contact portion 253 for abutting against a front and a rear of the tip end of the audio plug connector 3, respectively. At the same time, due to elastic deformation of the elastic arms 252, 254, there is a contact pressure with respect to the audio plug connector 3 so that a favorable elastic spring force can be attained. The first elastic arm 252 is located under the tip end of the audio plug connector 3 and the second elastic arm 254 is located at a side of the tip end of the audio plug connector 3. The first contact portion 253 and the second contact portion 255 of the contact terminal 25 electrically abutting against a lower portion and a side portion of the tip end of the mating audio plug connector 3 respectively for preventing the audio plug connector 3 from being tilted to a side of the plug insertion hole 19 so as to form a steady electrical connection between the audio jack connector 1 and the corresponding audio plug connector 3.

As described above, the audio jack connector 1 utilizes the contact terminal 25 for making the audio plug connector 3 disposed in the plug insertion hole 19 of the insulating housing 10 of the audio jack connector 1 firmly by means of the first contact portion 253 and the second contact portion 255 abutting against the lower portion and the side portion of the tip end of the audio plug connector 3 respectively so as to form a steady electrical connection between the audio jack connector 1 and the corresponding audio plug connector 3.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector for receiving an audio plug connector with a tip end, comprising:

an insulating housing defining a plug insertion hole from a front end to a rear end thereof for receiving the audio plug connector and a recess communicating with a rear end of the plug insertion hole; and a plurality of terminals disposed in the insulating housing, the terminals including a contact terminal received in the recess and having a base portion received in a bottom of the recess, one end of the base portion being bent upward and extended towards the other end of the base portion to form a first elastic arm located over the base portion and under the tip end of the audio plug connector when the audio plug connector is inserted in the plug insertion hole, a side edge of the base portion being extended upward and then bent along the axis of the plug insertion hole to form a second elastic arm of substantially L shape located at a side of the tip end of the audio plug connector when the audio plug connector is inserted in the plug insertion hole, a first contact portion and a second contact portion being protruded into the plug insertion hole from free ends of the first elastic arm and the second elastic arm, respectively, for abutting against a lower portion and a side portion of the tip end of the audio plug connector.

2. The audio jack connector as claimed in claim 1, wherein the first and second contact portions are formed by the free ends of the first elastic arm and the second elastic arm being arched into the plug insertion hole, respectively.

3. The audio jack connector as claimed in claim 1, wherein the first contact portion is in rear of the second contact portion for abutting against a front and a rear of the tip end of the audio jack connector, respectively.

4. The audio jack connector as claimed in claim 1, wherein the contact terminal further has a soldering portion extended from the base portion and exposed outside the recess.

5. The audio jack connector as claimed in claim 1, wherein a portion of an inner wall of the recess is protruded to form a preventing board spaced from a bottom wall of the recess and located between the base portion and the first contact portion of the contact terminal, the base portion is of substantially plate shape and located between the preventing board and the bottom wall of the recess.

6. The audio jack connector as claimed in claim 5, wherein a portion of the bottom wall of the recess defines a locating groove, a portion of the base portion protrudes downward to form a tab buckled into the locating groove.

* * * * *